US010654554B2

(12) United States Patent
Hörmann et al.

(10) Patent No.: US 10,654,554 B2
(45) Date of Patent: May 19, 2020

(54) METHOD FOR OPERATING A COOLING SYSTEM OF A SHIP

(71) Applicant: MAN DIESEL & TURBO SE, Augsburg (DE)

(72) Inventors: Peter Hörmann, Mering (DE); Jürgen Gutmann, Dasing (DE); Zhouxiang Xing, Augsburg (DE)

(73) Assignee: MAN Energy Solutions SE, Augsburg (DE)

( * ) Notice: Subject to any disclaimer, the term of this patent is extended or adjusted under 35 U.S.C. 154(b) by 65 days.

(21) Appl. No.: 15/660,666

(22) Filed: Jul. 26, 2017

(65) Prior Publication Data

US 2018/0029685 A1 Feb. 1, 2018

(30) Foreign Application Priority Data

Jul. 27, 2016 (DE) ..... 10 2016 213 787

(51) Int. Cl.
*B63J 2/12* (2006.01)
*B63H 21/38* (2006.01)
(Continued)

(52) U.S. Cl.
CPC ..... *B63J 2/12* (2013.01); *B63H 21/383* (2013.01); *F01P 3/207* (2013.01); *B63J 2002/005* (2013.01)

(58) Field of Classification Search
CPC ..... B63H 21/383; B63J 2/12; B63J 2002/005; F01P 3/207; F01P 2003/187; F01P 7/165
See application file for complete search history.

(56) References Cited

U.S. PATENT DOCUMENTS 5,394,854 A * 3/1995 Edmaier ..... F01P 7/165 123/542
6,821,171 B1 * 11/2004 Wynveen ..... B63H 21/383 123/41.08
(Continued)

FOREIGN PATENT DOCUMENTS

CN 102490891 6/2012
CN 202609071 U 12/2012
(Continued)

OTHER PUBLICATIONS

Machine translaiton of KR-20120015402-A; retrieved Feb. 14, 2019 (Year: 2019).*
(Continued)

*Primary Examiner* — Eric S Ruppert
*Assistant Examiner* — Hans R Weiland
(74) *Attorney, Agent, or Firm* — Cozen O'Connor

(57) ABSTRACT

A method for operating a cooling system of a ship, having a sea water part system with a sea water pump (14*a*, 14*b*) and at least one first cooling water circuit. The first cooling water circuit includes a bypass in a heat exchanger coupling the sea water part system and the first cooling water circuit and a control valve. A position of the control valve determines a cooling water proportion of the first cooling water circuit that is conducted via the heat exchanger and a cooling water proportion of the first cooling water circuit that is conducted via the bypass. The position of the control valve is controlled such that an advance cooling water temperature corresponds to a set point value. The rotational speed of the sea water pump is controlled based on the position of the control valve.

14 Claims, 6 Drawing Sheets

(51) Int. Cl.
*F01P 3/20* (2006.01)
*B63J 2/00* (2006.01)

(56) References Cited

U.S. PATENT DOCUMENTS

| | | | | |
|---|---|---|---|---|
| 2016/0076434 | A1* | 3/2016 | Yin | F01P 3/207 123/41.02 |
| 2017/0241323 | A1* | 8/2017 | Yin | B63H 21/383 |

FOREIGN PATENT DOCUMENTS

| | | |
|---|---|---|
| CN | 104354849 | 2/2015 |
| JP | 2002 274 493 | 9/2002 |
| KR | 10 2010 0 080 566 | 7/2010 |
| KR | 10 2012 0 015 402 | 2/2012 |
| KR | 20120015402 A * | 2/2012 |
| KR | 20130027319 | 3/2013 |
| WO | WO 2016/028474 | 2/2016 |

OTHER PUBLICATIONS

Office Action dated Jan. 2, 2020 issued in Chinese Patent Application No. 201710623841.1.

* cited by examiner

METHOD FOR OPERATING A COOLING SYSTEM OF A SHIP

BACKGROUND OF THE INVENTION

1. Field of the Invention

The invention relates to a method for operating a cooling system of a ship.

2. Description of the Related Art

The fundamental construction and the fundamental mode of operation of a cooling system of a ship are known from practice to the person skilled in the art addressed here and schematically shown in FIG. 6. Accordingly, a cooling system 10 of a ship comprises a sea water part system 11 with a sea water pump 14 and at least one cooling water circuit 13 with a cooling water pump 28, which includes an assembly 42. The sea water part system 11 and the cooling water circuit 13 are coupled via a heat exchanger 12 such that in the region of the heat exchanger 12 the cooling water of the first cooling water circuit 13 is cooled by the sea water of the sea water part system 12. The first cooling water circuit 13 comprises a bypass 17 to the heat exchanger 12 coupling the sea water part system 11 and the first cooling water circuit 13 and a control valve 18, the position of which determines the cooling water proportion of the first cooling water circuit 13 that is conducted via the heat exchanger 12 and the cooling water proportion of the first cooling water circuit 13 that is conducted via the bypass. Here, the position of the control valve 18 is changed via an actuator 19 and determined by a controller 41 such that an advance cooling water temperature, which materialises by mixing the cooling water proportion conducted via the heat exchanger 12 and the cooling water proportion conducted via the bypass 17, corresponds to a corresponding set point value. In the case of cooling water systems 10 according to FIG. 6 known from practice, an actual value of the advance cooling water temperature is accordingly detected with a sensor 43, wherein dependent on the actual value of the advance cooling water temperature the controller 41 influences the position of the control valve 18 via the actuator 19. The sea water pump 14 of the sea water part system 11 and the cooling water pump 28 of the first cooling water circuit 13 are operated with full rotational speed in cooling systems of a ship known from practice. Relatively much energy is required because of this.

SUMMARY OF THE INVENTION

The present invention is based on creating a method for operating a cooling system of a ship.

According to one aspect of the invention, the rotational speed of the sea water pump of the sea water part system is controlled dependent on the position of the control valve of the first cooling water circuit, via the position of which the cooling water proportion of the first cooling water circuit that is conducted via the heat exchanger and the cooling water proportion of the first cooling water circuit that is conducted via the bypass is determined. Accordingly, the position of that control valve of the first cooling water circuit that determines the cooling water proportion of the first cooling water circuit that is conducted via the heat exchanger and the cooling water component of the first cooling water circuit that is conducted via the bypass is utilised as primary control variable for controlling the rotational speed of the sea water pump of the sea water part system. The control for this control valve of the first cooling water circuit known from practice dependent on the actual value of the advance cooling water temperature continues to remain active. The control concept according to the invention has the advantage that by varying the rotational speed of the sea water pump energy can be saved. The control concept is suitable in particular also for use with such cooling systems in the case of which the heat exchanger, which couples the sea water pump system and the first cooling water circuit to one another, is not embodied as central heat exchanger.

Preferentially, the rotational speed of the sea water pump of the sea water part system is controlled in such a manner dependent on the position of this control valve of the first cooling water circuit that the cooling water proportion of the first cooling water circuit conducted via the heat exchanger becomes as large as possible and is thus approximated in the direction of a corresponding set point value. In particular when as much cooling water as possible is conducted via the heat exchanger, i.e. when the cooling water proportion of the first cooling water circuit conducted via the heat exchanger is as large as possible, the rotational speed of the sea water pump can be decreased more, as a result of which more energy can be saved.

According to an advantageous further development, the rotational speed of the sea water pump of the sea water part system is controlled furthermore dependent on the temperature of the sea water downstream of the heat exchanger, preferentially in such a manner that in particular when the temperature of the sea water downstream of the heat exchanger becomes greater than a limit value, the rotational speed of the sea water pump is increased so that the temperature of the sea water becomes smaller than the limit value or corresponds to the same. By doing so it is avoided that salt deposits settle in the cooler or in parts of the cooling system.

According to an advantageous further development, the cooling system comprises a second cooling water circuit, wherein the second cooling water circuit and the sea water part system or the second cooling water circuit and the first cooling water circuit are coupled via a heat exchanger, in the region of which the cooling water of the second cooling water circuit is cooled through the sea water of the seat water part system or the cooling water of the first cooling water circuit. The second cooling water circuit comprises a bypass to the heat exchanger coupling the second cooling water circuit and the sea water part system or the second cooling water circuit and the first cooling water circuit and a control valve, via the position of which the cooling water proportion of the second cooling water circuit that is conducted via the heat exchanger and the cooling water proportion of the second cooling water circuit that is conducted via the bypass is determined. The position of the control valve of the second cooling water circuit is determined in such a manner that a return cooling water temperature upstream of the heat exchanger corresponds to a corresponding set point value. The rotational speed of the sea water pump of the sea water part system is controlled, furthermore, dependent on the position of the control valve of the second cooling water circuit preferentially in such a manner that on the one hand the cooling water proportion of the first cooling water circuit conducted via the heat exchanger of the first cooling water circuit becomes as large as possible and is thus approximated in the direction of a corresponding set point value, and that on the other hand the cooling water proportion of the second cooling water circuit conducted via the heat exchanger of the second cooling water circuit becomes as large as possible and is thus approximated in the direction of a corresponding set point value. This further development of the invention has the advantage that the rotational speed of the sea water pump can be controlled even more advantageously and the potential of an energy saving while maintaining good cooling can be exploited even better.

According to an advantageous further development, the first cooling water circuit comprises a cooling water pump, a low-temperature charge air cooler, at least one cooler for cooling at least one further assembly, and a further control valve, via the switching position of which a cooling water proportion of the first cooling water circuit conducted via the low-temperature charge air cooler is adjustable. The rotational speed of the cooling water pump of the first cooling water circuit is controlled dependent on the position of the or each control valve of the first cooling water circuit, preferentially in such a manner that the cooling water proportion of the first cooling water circuit conducted via the low-temperature charge air cooler becomes as large as possible and is thus approximated in the direction of a corresponding set point value. In addition to the rotational speed of the sea water pump, the rotational speed of the cooling water pump of the first cooling water circuit is additionally controlled with this advantageous further development in order to reduce the rotational speed of the same as far as possible and thereby save energy. In particular when the second cooling water circuit and the first cooling water circuit are coupled via the respective heat exchanger, the rotational speed of the cooling water pump of the first cooling water circuit is additionally controlled dependent on the position of the control valve of the second cooling water circuit. This characterising feature allows an effective control of the rotational speed of the cooling water pump of the first cooling water circuit.

According to a version, the first cooling water circuit comprises a cooling water pump, a low-temperature charge air cooler, a high-temperature charge air cooler, at least one cooler for cooling at least one further assembly, and a further control valve, via the switching position of which a cooling water proportion conducted via the low-temperature charge air cooler and a cooling water proportion conducted via the high-temperature charge air cooler is adjustable. A rotational speed of the cooling water pump of the first cooling water circuit is then controlled dependent on the position of this control valve of the first cooling water circuit preferentially in such a manner that the cooling water proportion conducted via the high-temperature charge air cooler becomes as large as possible and is thus approximated in the direction of a corresponding set point value. This version also allows an effective control of the rotational speed of the sea water pump and of the rotational speed of the cooling water pump of the first cooling water circuit for the preferably optimal energy saving while maintaining the necessary cooling function.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

The present invention relates to a method for operating a cooling system of a ship.

Figure 1:
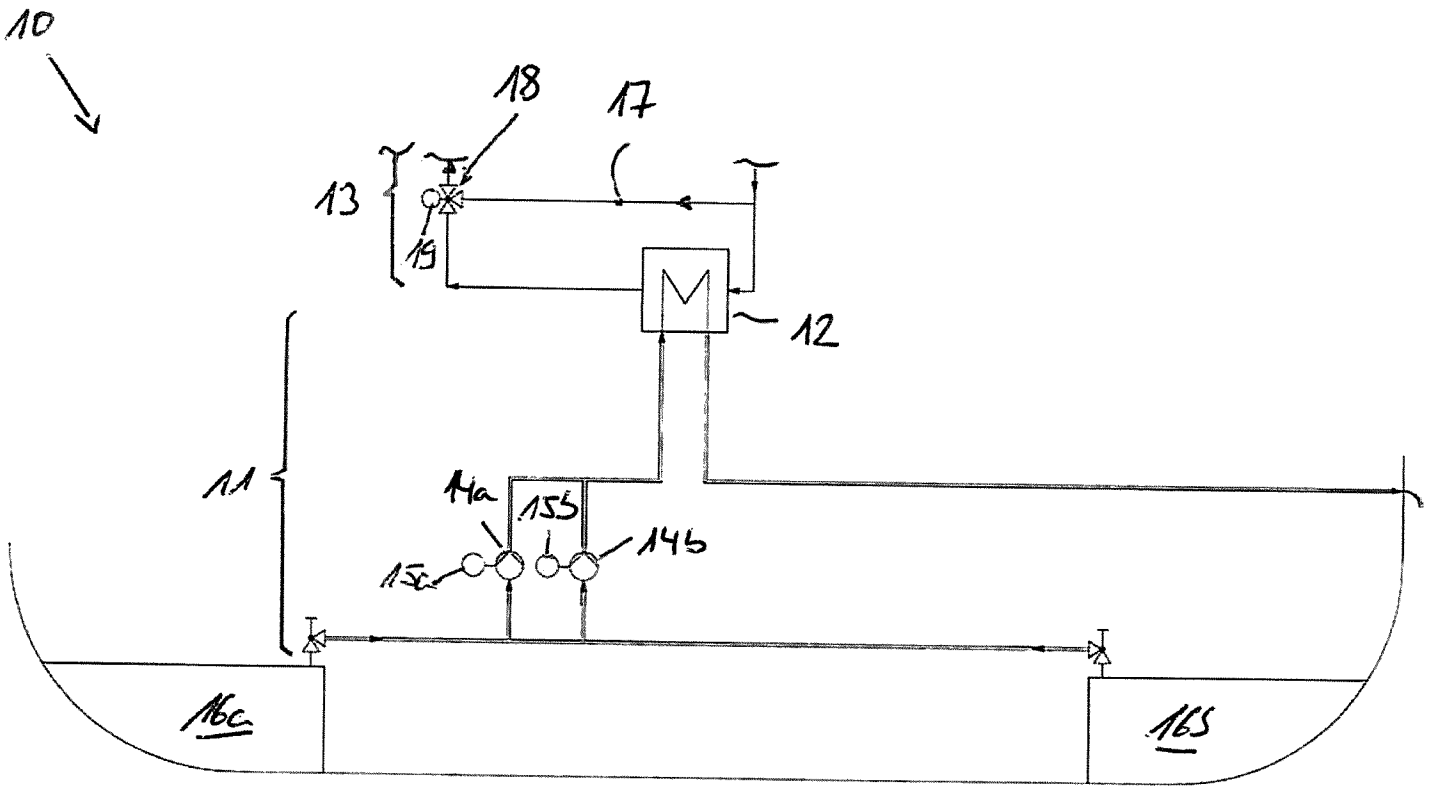
FIG. 1: is a block diagram of a cooling system of a ship.

FIG. 1 shows an extract of a cooling system 10 of a ship in the region of a sea water part system 11 of the cooling system 10 and of a first cooling water circuit 13 of the cooling system 10 coupled to the sea water part system 11 via a heat exchanger 12.

The sea water part system 11 comprises a sea water pump or at least one sea water pump, in the shown exemplary embodiment two sea water pumps 14*a*, 14*b*, each of which are driven by a respective actuator 15*a*, 15*b*.

By way of the sea water pumps 14*a*, 14*b* of the sea water part system 11, sea water can be extracted from sea water containers 16*a*, 16*b* and delivered via the heat exchanger 12, which couples the sea water part system 11 to the first cooling water circuit 13. In the first cooling water circuit 13, cooling water is delivered to cool assemblies of the ship, which are not shown in FIG. 1. The cooling water of the first cooling water circuit 13 is cooled in the region of the heat exchanger 12 with the help of the sea water of the sea water part system 11 likewise conducted via the heat exchanger 12. The first cooling water circuit 13 comprises a bypass 17 to the heat exchanger 12 coupling the sea water part system 11 and the first cooling water circuit 13 and a control valve 18, which in the shown exemplary embodiment is embodied as three-way control valve and the position of which can be changed via an actuator 19. The position of the control valve 18 of the first cooling water circuit 13 determines the cooling water proportion of the first cooling water circuit 13 that is conducted via the heat exchanger 12 and the cooling water proportion of the first cooling water circuit 13 that is conducted via the bypass 17. Accordingly, cooling water conducted via the heat exchanger and cooling water conducted via the bypass 17 is mixed in the region of the control valve 18, wherein downstream of the control valve 18 an actual value of an advance cooling water temperature materialises, namely dependent on the mixture of the cooling water proportion conducted via the heat exchanger 12 and of the cooling water proportion conducted via the bypass 17. Here, the position of the control valve 18 is adjusted via the actuator 19 in such a manner that the actual value of the advance cooling water temperature corresponds to a corresponding set point value.

According to one aspect of the invention, the rotational speed of the sea water pump, in FIG. 1 the rotational speed of the sea water pump 14*a* and/or the rotational speed of the sea water pump 14*b*, is controlled dependent on the position of the control valve 18 of the first cooling water circuit 13, via the position of which the cooling water proportion of the first cooling water circuit 13 that is conducted via the heat exchanger 12 and the cooling water proportion of the first cooling water circuit 13 that is conducted via the bypass 17 is determined. Accordingly, the position of the valve 18 serves as primary control variable as a function of which the rotational speed of the one or more sea water pumps 14*a* and/or 14*b* shown in FIG. 1 is controlled. The control of the control valve 18 known from practice, i.e. the control of the actual value of the advance water cooling temperature via the control valve 18 remains active.

The rotational speed of the sea water pump 14*a* and/or 14*b* dependent on the position of the control valve 18 of the first cooling water circuit 13 is controlled in such a manner that the cooling water proportion of the first cooling water circuit 13 conducted via the heat exchanger 12 becomes as large as possible and is thus approximated in the direction of a corresponding set point value.

In this connection it is mentioned that for the cooling water proportion of the first cooling water circuit 13, which is conducted via the heat exchanger 12, a maximum value, for example 90% is typically preset, so that a minimum quantity of the cooling water proportion of, example 10%, is always conducted via the bypass 17. The adjustment or control of the rotational speed of the sea water pump 14*a* and/or 14*b* dependent on the position of the control valve 18 is effected in such a manner that the cooling water proportion of the first cooling water circuit conducted via the heat exchanger 12 is approximated in the direction of its maximum value and thus corresponding set point value, so that accordingly as much cooling water as possible of the first cooling water circuit 13 is always conducted via the heat exchanger 12, but a minimum quantity of cooling water always flows via the bypass 17.

By suitably reducing the rotational speed of the sea water pump 14*a* and/or 14*b*, the sea water quantity conducted through the heat exchanger 12 is reduced and by way of this the cooling water proportion of the first cooling water circuit 13 that is conducted via the heat exchanger 12 indirectly increased.

With the above control of the rotational speed of the sea water pump 14*a* and/or 14*b*, the temperature of the sea water can be taken into account, furthermore, downstream of the heat exchanger 12. In particular when the temperature of the sea water downstream of the heat exchanger 12 becomes greater than a preset limit value, the rotational speed of the sea water pump 14*a* and/or 14*b* is increased, so that the temperature of the sea water downstream of the heat exchanger 12 then becomes smaller than this limit value or corresponds to the same.

As already explained, FIG. 1 shows two sea water pumps 14*a*, 14*b* in the sea water part system 11. There it can be provided that both sea water pumps 14*a*, 14*b* are embodied as pumps that are controllable in terms of their rotational speed, wherein the rotational speed of both sea water pumps 14*a* and 14*b* can then be controlled in the abovementioned manner. In contrast with this it is also possible, however, that one of the sea water pumps 14*a* or 14*b* is designed as a constant delivery pump, wherein the rotational speed of the other sea water pump 14*b* or 14*a* is then controlled in the above manner.

Figure 2:
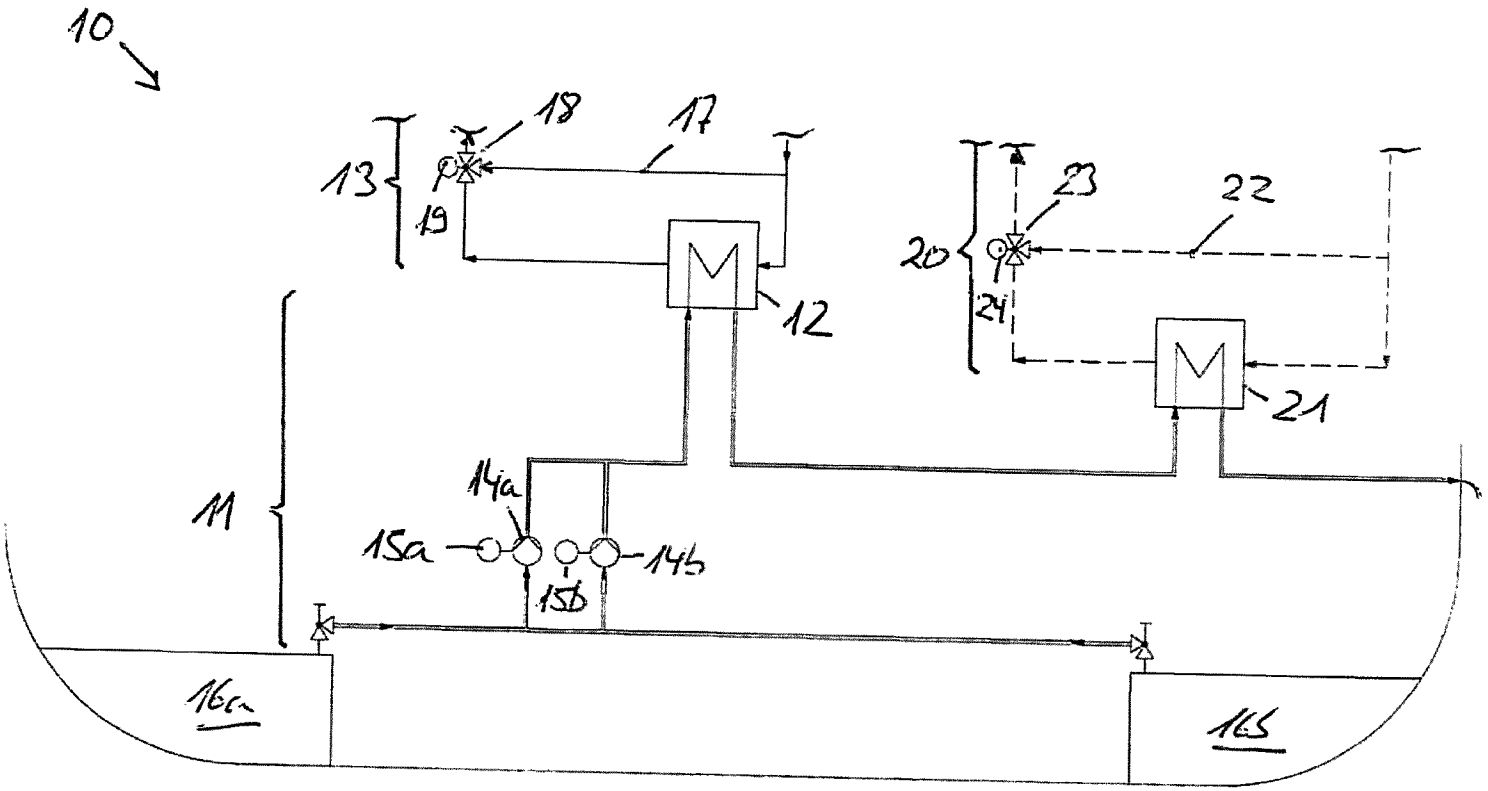
FIG. 2: is a block diagram of a cooling system of a ship.

FIG. 2 shows a modification of the cooling system 10 of FIG. 1, wherein the cooling system 10 of FIG. 2 in addition to the first cooling water circuit 13 comprises a second cooling water circuit 20. In the exemplary embodiment of FIG. 2, the second cooling water circuit 20 is likewise coupled to the sea water part system 11 via a heat exchanger 21, namely in such a manner that in the region of the heat exchanger 21 the cooling water of the second cooling water circuit 20 is cooled via the sea water of the sea water part system 11, wherein the two heat exchangers 12, 21, via which the two cooling water circuits 13, 20 are coupled to the sea water part system, are connected in series in such a manner that the sea water of the sea water part system 11 is initially conducted via the heat exchanger 12, which couples the sea water part system 11 and the first cooling circuit 13, and following this, via the heat exchanger 21, which couples the sea water part system 11 and the second cooling circuit 20.

Like the first cooling circuit 13, the second cooling circuit 20 comprises a bypass 22 and a control valve 23. The position of the control valve 23 of the second cooling water circuit 20 can be changed via an actuator 24. The position of the control valve 23 of the second cooling water circuit 20 determines the cooling water proportion of the second cooling water circuit 20 that is conducted via the heat exchanger 21, and the cooling water proportion of the second cooling water circuit 20 that is conducted via the bypass 22 to the heat exchanger 21. Here, the position of the control valve 23 is preferentially determined in such a manner that a return temperature upstream of the heat exchanger 21 of the cooling water of the second cooling water circuit 20 corresponds to a corresponding predetermined set point value.

In the exemplary embodiment of FIG. 2, the rotational speed of the sea water pump 14*a* and/or 14*b* is not only determined dependent on the position of the control valve 19 of the first cooling water circuit 13, but additionally dependent on the position of the control valve 23 of the second cooling water circuit 20.

Here, the rotational speed of the sea water pump 14*a* and/or 14*b* is controlled in such a manner that on the one hand the cooling water proportion of the first cooling water circuit 13 that is conducted via the heat exchanger 12 of the first cooling water circuit 13 becomes as large as possible and is thus approximated in the direction of the corresponding set point value, and that on the other hand the cooling water proportion of the second cooling water circuit 20 that is conducted via the heat exchanger 21 of the second cooling water circuit 20 becomes as large as possible and is thus approximated in the direction of a corresponding set point value.

As already described in connection with the first cooling water circuit 13, it is also provided for the second cooling water circuit 20 to always conduct a minimum quantity of cooling water via the bypass 22 so that the corresponding set point value for the cooling water proportion of the second cooling water circuit 20 conducted via the heat exchanger 21 is smaller than 100%.

In the version of FIG. 2, in which the control of the rotational speed of the sea water pump 14*a* and/or of the sea water pump 14*b* takes place dependent on the position of the control valves 19 and 23, the temperature of the sea water is also taken into account during the control of the rotational speed of the sea water pump 14*a* and/or of the sea water pump 14*b*, namely here the temperature of the sea water downstream of the two heat exchangers 12 and 21, i.e. directly downstream of the heat exchanger 21. In particular when this temperature of the sea water becomes higher than a limit value, the rotational speed of the sea water pump 14*a* and/or of the sea water pump 14*b* is increased, so that the temperature of the sea water in turn becomes smaller than the respective limit value or corresponds to the same.

Figure 3:
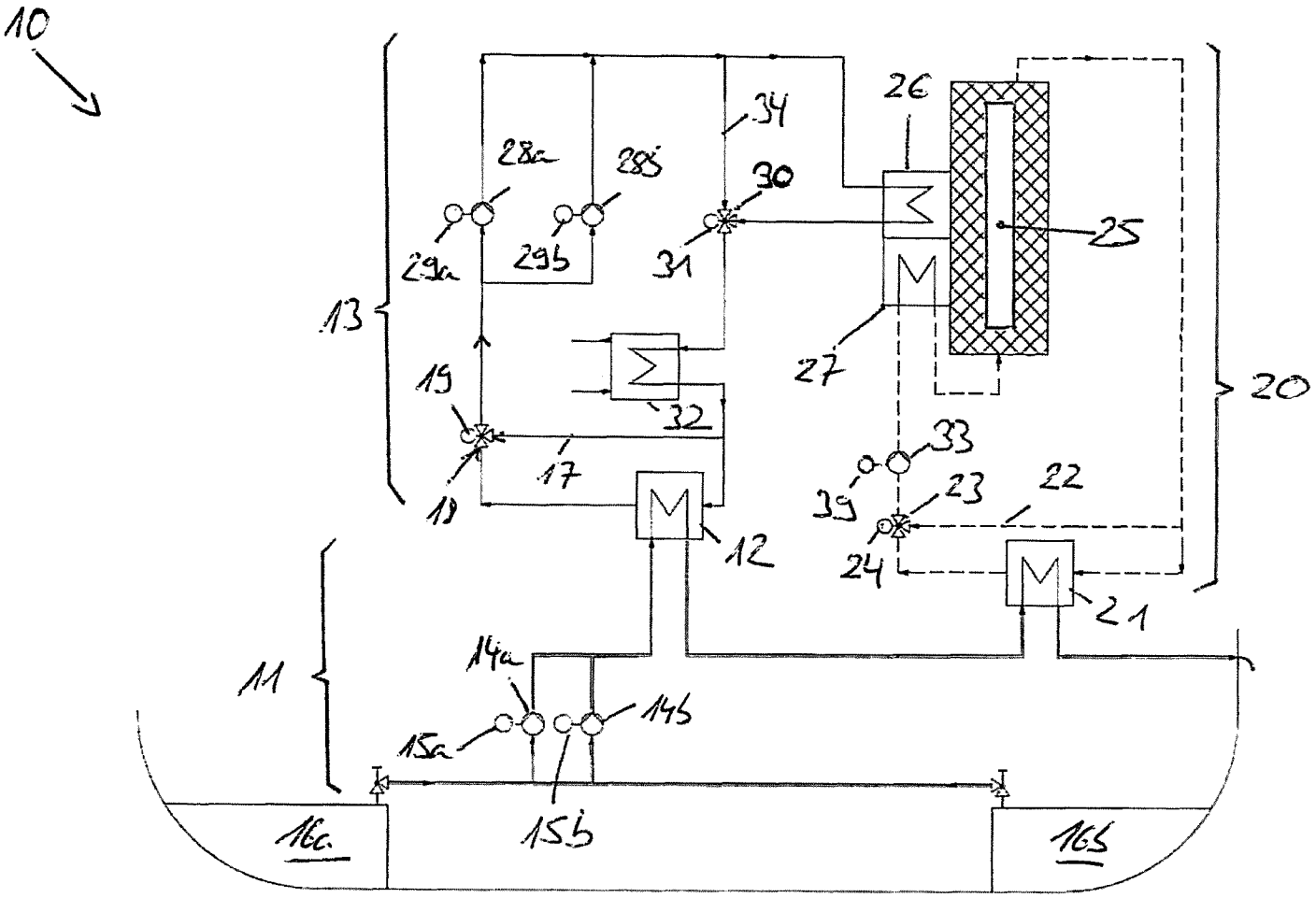
FIG. 3: is a block diagram of a cooling system of a ship.

FIG. 3 shows a further development of the cooling system 10 of FIG. 2, wherein in FIG. 3, in addition to the assemblies shown in FIG. 2, further assemblies are shown, in particular an internal combustion engine 25 to be cooled, which is assigned a low-temperature charge air cooler 26 and a high-temperature charge air cooler 27. The low-temperature charge air cooler 26 is incorporated in the first cooling circuit 13 and the high-temperature charge air cooler 27 in the second temperature circuit 20. As further assemblies of the first cooling water circuit 13, FIG. 2 shows a cooling water pump, namely at least one cooling water pump, in the shown exemplary embodiment specifically two cooling water pumps 28*a*, 28*b*, which are each driven by an actuator 29*a*, 29*b*, serve to circulate the cooling water in the first cooling water circuit 13. As further assembly of the first cooling water circuit 13, FIG. 3 additionally shows a further control valve 30, the position of which is influenced via an actuator 31, and a further cooler 32, which is embodied in particular as lubricating oil cooler for cooling the lubricant oil for the internal combustion engine 25. As further assembly of the second cooling circuit 20, FIG. 3 shows a cooling water pump 33 with an actuator 39, which circulates the coolant in the second cooling circuit 20. In FIG. 3, the control of the rotational speed of the sea water pump 14*a* and/or 14*b* takes place, as described in connection with FIG. 2, dependent on the position of the switching valve 18 of the first cooling water 13 and dependent on the position of the switching valve 23 of the second cooling water circuit 20 as well if applicable dependent on the temperature of the sea water downstream of the heat exchanger 21.

In FIG. 3, the rotational speed of the cooling water pump 28*a* and/or 28*b* is controlled dependent on the position of the two switching valves 18 and 30 of the first cooling water circuit 13. As already explained, the position for the control valve 18 is determined in such a manner that downstream of the control valve 18 a desired actual value of the advance cooling water temperature materialises. By way of the position of the control valve 30, the cooling water proportion of the first cooling water circuit 13 conducted via the low-temperature charge air cooler 26 is adjusted and then also that proportion that is conducted past the low-temperature charge air cooler 26. Downstream of the control valve 30, the cooling water proportions conducted via the low-temperature charge air cooler 26 and past the same are mixed again in order to be then conducted via the cooler 32 embodied as lubricating oil cooler for cooling the lubricating oil.

The rotational speed of the cooling water pump 28*a* and/or 28*b* is determined dependent on the switching position of the switching valves 18 and 30 in such a manner that as much water as possible is conducted via the low-temperature charge air cooler 26, i.e. that the cooling water proportion of the first cooling water circuit 13 conducted via the low-temperature charge air cooler 26 becomes as large as possible and is thus approximated in the direction of a corresponding set point value. Here, it is not the entire quantity of the cooling water that is delivered via the cooling water pump 28*a* and/or 28*b* that is in turn conducted via the low-temperature charge air cooler 26, but it is ensured that a minimal cooling water proportion of this cooling water of the first cooling water circuit 13 is always conducted via a bypass 34 to the low-temperature charge air cooler 26. Through this control of the rotational speed of the cooling water pump 28*a* and/or 28*b* of the first cooling water circuit 13, the rotational speed of the cooling water pump 28*a* and/or 28*b* is thus reduced, namely so far until the cooling water quantity conducted via the low-temperature charge air cooler or the cooling water proportion of the cooling water of the first cooling water circuit 13 conducted via the low-temperature charge air cooler 26 corresponds to a maximum value and thus its corresponding set point value.

Furthermore, during the control of the rotational speed of the cooling water pump 28*a* and/or 28*b*, the temperature of the medium cooled in the cooler 32, i.e. in FIG. 3 of the lubricating oil cooled in the cooler 32, is taken into account. Should the temperature of the lubricating oil leaving the cooler 32 be greater than a limit value, the rotational speed of the cooling water pump 28*a* and/or 28*b* is increased namely so far until the temperature of the lubricating oil that leaves the cooler 32 falls below its limit value or corresponds to the same. In addition to the cooler 32, further coolers for cooling a medium can be installed in the first cooling circuit 13, for example a cooler for an auxiliary drive unit and/or a cooler for an air conditioning system and/or a cooler for an injection nozzle cooling system. Here, the temperature of each medium to be cooled in the respective cooler is then preferentially monitored and compared with a corresponding limit value, wherein in particular when a corresponding limit value is exceeded, the rotational speed of the coolant pump 28*a* and/or 28*b* is increased in order to ensure a proper cooling of the receptive medium to be cooled in the region of the respective cooler.

In FIG. 3, both the cooling water pumps 28*a* and 28*b* can be controllable cooling water pumps, wherein both cooling water pumps 28*a* and 28*b* can then be controlled with regard to their rotational speed in the above described manner. In contrast with this it is also possible, however, that merely one of these cooling water pumps 28*a* or 28*b* is controllable, whereas the other cooling water pump 28*b* and 28*s* is embodied as constant delivery pump. In this case, merely the cooling water pump that is controllable with respect to its rotational speed is then controlled with respect to its rotational speed in the manner described above.

In FIG. 3, the rotational speed of the cooling water pump 33 of the second cooling water circuit 20 can be controlled, furthermore, namely dependent on the cooling requirement of the internal combustion engine 25.

Figure 4:
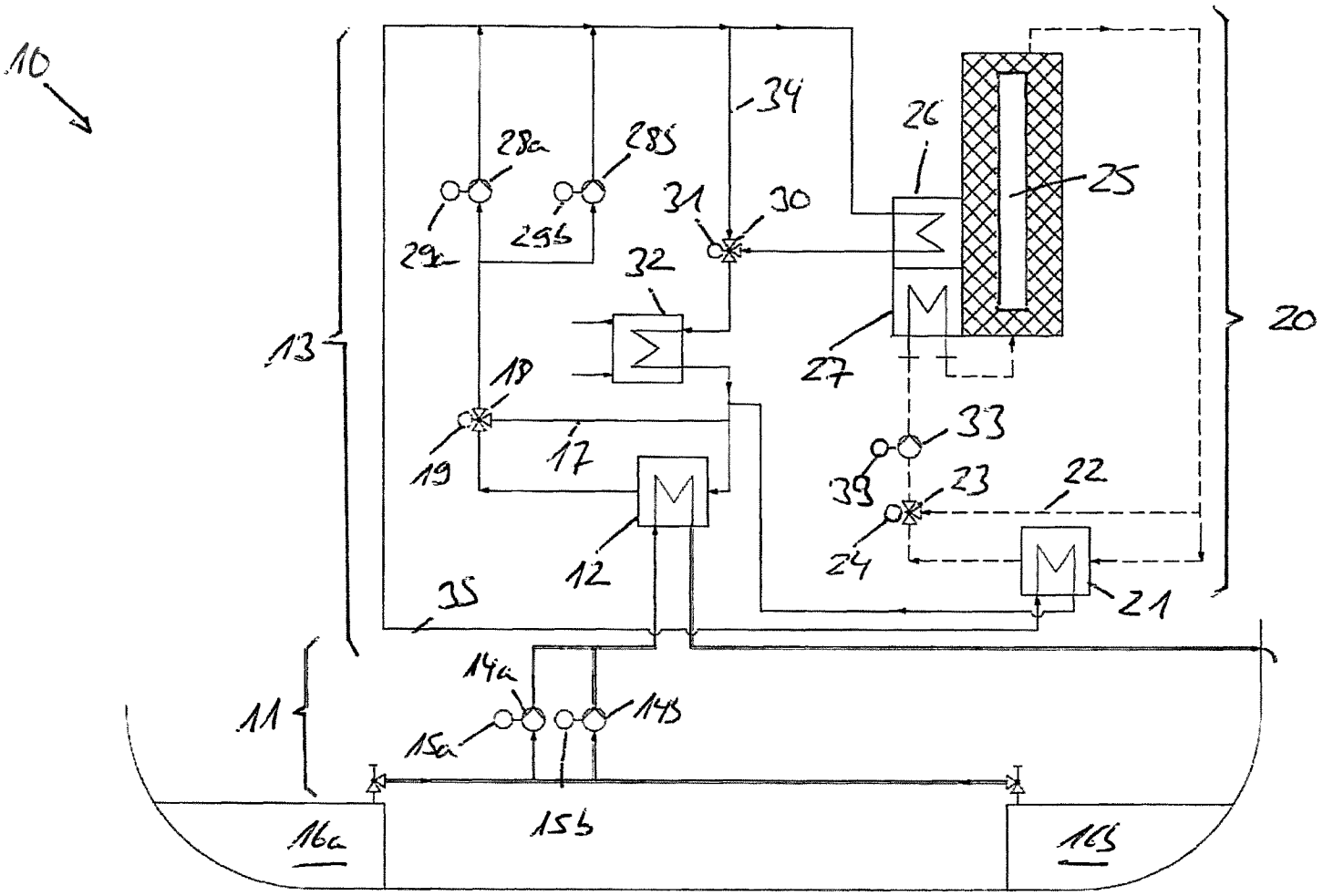
FIG. 4: is a block diagram of a cooling system of a ship.

FIG. 4 shows a modification of the cooling system 10 of FIG. 3, wherein the cooling system 10 of FIG. 4 differs from the cooling system 10 of FIG. 3 in that the second heat exchanger 21, which serves for cooling the cooling water of the second cooling circuit 20, is not coupled to the sea water part system 11, but rather to the first cooling circuit 13. Accordingly it is evident from FIG. 4 that downstream of the cooling water pump 28*a* and 28*b* coolant of the first cooling circuit 13 is conducted via the line 35 to the heat exchanger 21, to cool the cooling water of the second cooling circuit 20 in the region of the heat exchanger 21. In the region of the return of the first cooling circuit 13, this cooling water of the first cooling circuit 13 conducted via the heat exchanger 21 is returned to the cooling circuit 13, namely downstream of the cooler 32 and upstream of the heat exchanger 12, namely upstream of the bypass 17. For all other shown assemblies, the exemplary embodiment of FIG. 4 corresponds to the exemplary embodiment of FIG. 3, so that for avoiding unnecessary repetitions reference is made to the above explanations. With the cooling system 10 of FIG. 4, the control of the rotational speed of the sea water pumps 14*a* and/or 14*b* of the sea water part system 11 takes place preferentially as described in connection with FIG. 1.

With the cooling water system 10 of FIG. 4, the control of the rotational speed of the cooling water pump 28*a* and/or 28*b* of the first cooling water circuit 13 does not only take place dependent on the switching position of the switching valves 19 and 30 of the first cooling circuit 13, but furthermore dependent on the switching position of the control valve 23 of the second cooling circuit 20. Here, the rotational speed of the cooling water pump 28*a* and/or 28*b* is adapted in such a manner that as much cooling water as possible and thus a preferably high cooling water proportion of the second cooling water circuit 20 is conducted via the heat exchanger 21. To this end, the rotational speed of the cooling water pump 28*a* and/or 28*b* of the first cooling circuit 13 is correspondingly reduced so that less cooling water of the first cooling circuit 13 is conducted via the heat exchanger 21, which ultimately leads to an increase of the cooling water quantity of the second cooling circuit 20 conducted through the heat exchanger 21. Here, a minimum cooling water proportion of the second cooling circuit 20 is preferentially again conducted via the bypass 22 of the second cooling circuit 20. For this reason, the rotational speed of the cooling water pump 28*a* and/or 28*b* is reduced only so far that the cooling water proportion of the second cooling water circuit 20 conducted via the heat exchanger 21 maximally reaches its corresponding set point value, which corresponds to a maximum value of less than 100% and accordingly via the bypass 22 the conduction of a minimum cooling water quantity or of a minimum cooling water proportion is maintained. The rotational speed of the cooling water pump 33 of the second cooling water circuit 20 can be again controlled according to the requirements of the internal combustion engine 25.

Figure 5:
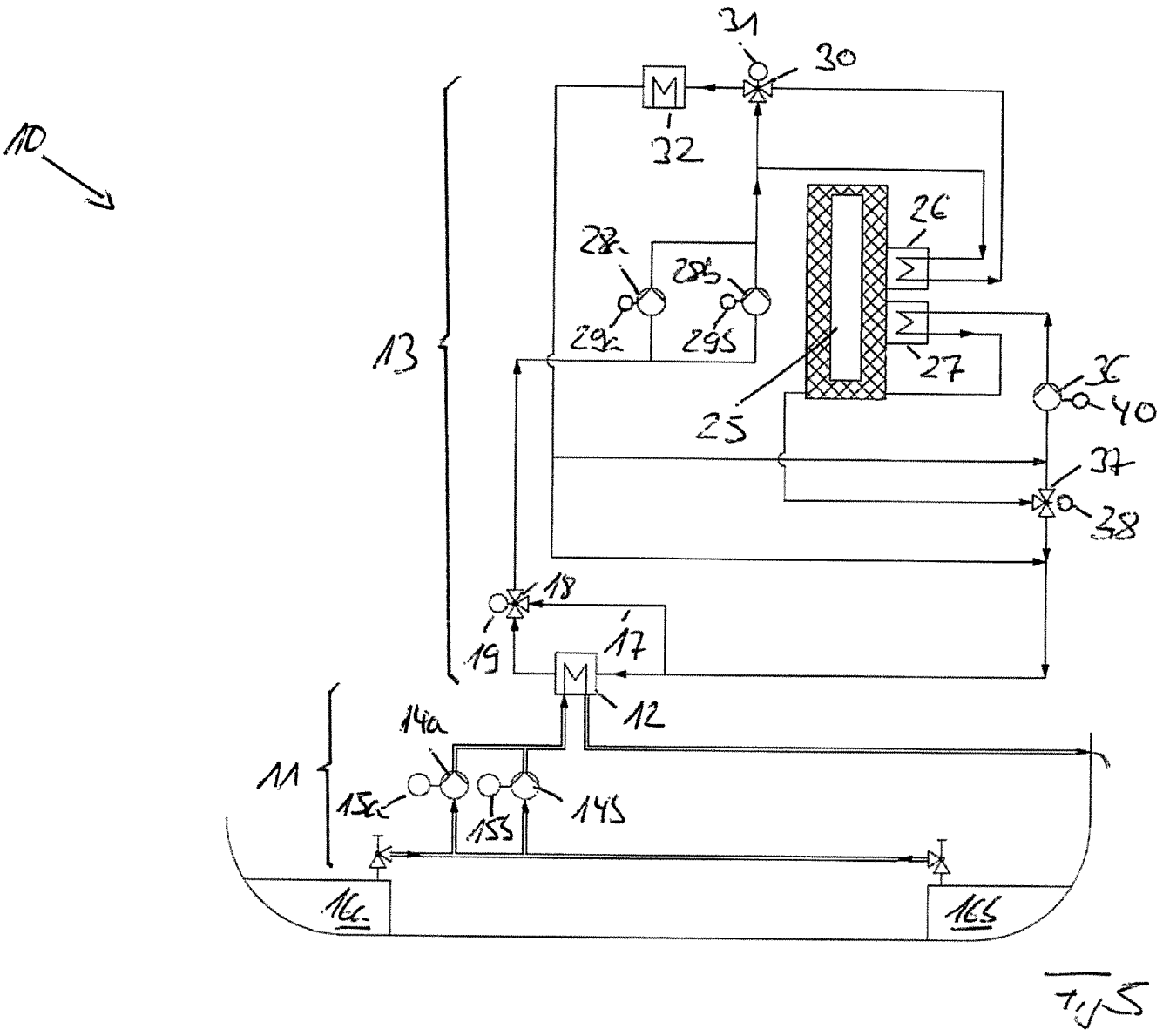
FIG. 5: is a block diagram of a cooling system of a ship.
Figure 6:
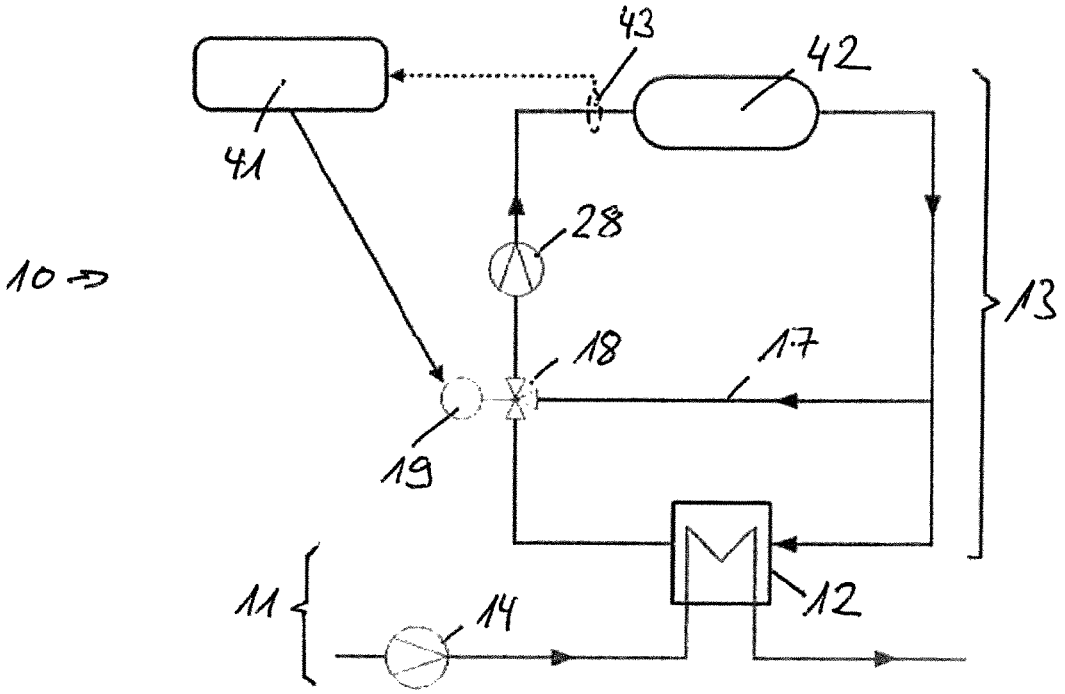
Prior Art Fig. 6
FIG. 6: is a block diagram for illustrating the prior art.

FIG. 5 shows a further modification of a cooling water system of a ship, wherein the cooling water system 10 of FIG. 5 differs from the cooling water system 10 of FIG. 4 in that merely a single cooling water circuit, i.e. first cooling water circuit 13 is present, so that the separate second cooling water circuit 20 is omitted. In agreement with the exemplary embodiments described above, the advance cooling water temperature upstream of the control valve 18 is adjusted in that the cooling water of the first cooling water circuit 13 is partly conducted via the heat exchanger 12 and partly via the bypass 17 to the heat exchanger 12, wherein the heat exchanger 12 of the sea water part system 11 couples the sea water part system 11 to the first cooling circuit 13 for cooling the cooling water of the cooling circuit 13.

The cooling water pump 28*a* and/or 28*b* delivers the cooling water of the first cooling water circuit 13. The switching position of the control valve 30 determines the cooling water proportion that is conducted via the low-temperature charge air cooler 26 and the proportion that is conducted past the low-temperature charge air cooler 26 via the cooler 32. Downstream of the cooler 32, the cooling water of the first cooling circuit 13 is divided, namely into a cooling water proportion that is conducted via the high-temperature charge air cooler 27 with the help of the pump 36 and into a cooling water proportion, which is conducted past the high-temperature charge air cooler 27 directly into the return in the direction of the heat exchanger 12. A control valve 37, which is adjustable by an actuator 38, determines these two cooling water proportions, i.e. that cooling water proportion which with the help of the pump 36 is conducted via the high-temperature charge air cooler 27 and that cooling water proportion, which is conducted past the high-temperature charge air cooler 27. The control of the rotational speed of the sea water pump 14*a* and/or 14*b* of the sea water part system 11 takes place in FIG. 5 as described in connection with FIG. 1.

The control of the rotational speed of the cooling water pump 28*a* and/or 28*b* of the first cooling circuit 13 takes place dependent on the position of the control valves 18 and/or 30 and/or 37, namely in such a manner that by way of a suitable adaptation of the rotational speed of the cooling water pump 28*a* and/or 28*b* it is ensured that as much cooling water as possible and thus a preferably high cooling water proportion is conducted via the high-temperature charge air cooler 27. However, a minimum cooling water proportion is again conducted past the high-temperature charge air cooler 27. The cooling water pump 36 can be controlled with respect to its rotational speed dependent on the requirements of the internal combustion engine 25.

The cooling water pumps 28*a*, 28*b*, 33 and 36 are each electromotorically driven cooling water pumps. By suitably changing the rotational speed of the corresponding actuators 29*a*, 29*b*, 39, 40, the rate of delivery of the corresponding pumps can be controlled. This is preferred.

It is pointed out that mechanically driven cooling water pumps 28*a*, 28*b*, 33, 36 can also be utilised, wherein throttles are then integrated in the cooling circuit which via the control are suitably adjusted.

Figure 7:
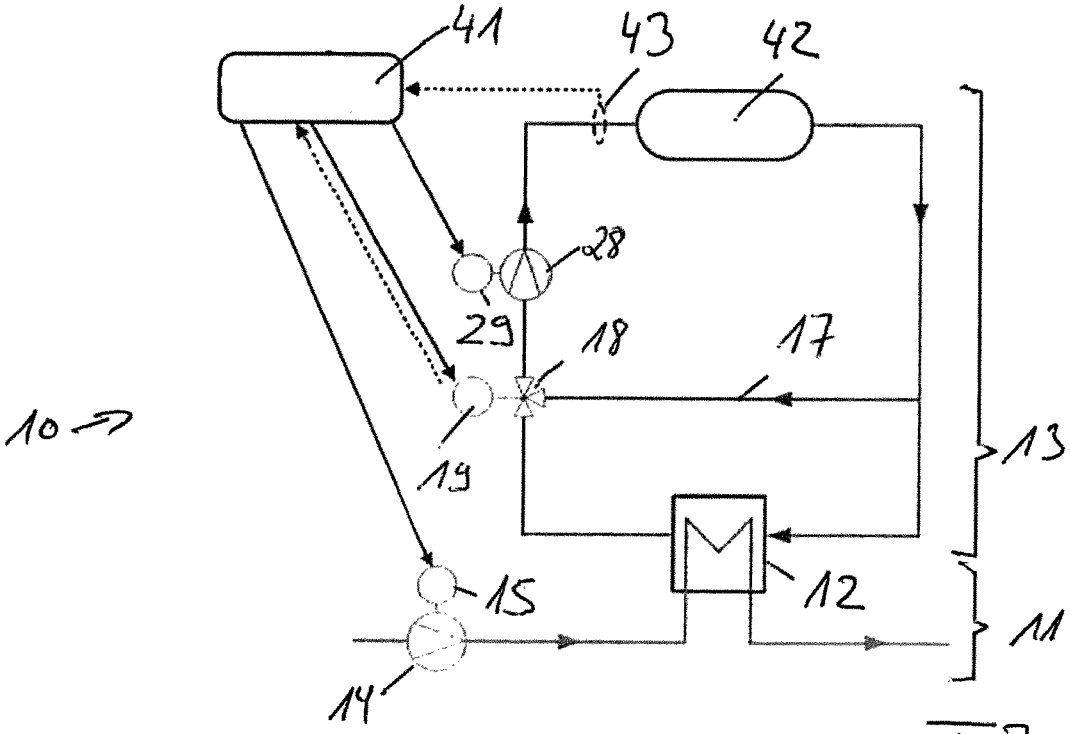
FIG. 7: is a block diagram for further illustrating the invention.

The exemplary embodiments of FIGS. 1 to 5 describe making reference to FIGS. 1 to 5 each have in common that as shown in FIG. 7 the control of the position of the control valve 18 dependent on the actual value of the advance cooling water temperature known from practice is retained. Dependent on the position of the control valve 18 of the first cooling water circuit 13, via the position of which the cooling water proportion of the first cooling water circuit 13 that is conducted via the heat exchanger 12 and the cooling water proportion of the first cooling water circuit 13 that is conducted via the bypass 17, the rotational speed of one or at least one sea water pump 14 is controlled by the controller 41. Furthermore, the rotational speed of one or at least one cooling water pump 28 of the cooling water circuit 13 is preferentially additionally controlled by the controller 41, namely also dependent on the position of the control valve 18. The rotational speed of the sea water pump 14 and/or of the cooling water pump 28 can be reduced, as a result of which energy can be saved. The method is carried out fully automatically.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating a cooling system of a ship having a sea water part system with a sea water pump that is coupled to at least one first cooling water circuit by a first heat exchanger such that a cooling water of the first cooling water circuit is cooled by a sea water of the sea water part system in a region of the first heat exchanger, the first cooling water circuit has a heat exchanger bypass and a control valve that determines a first cooling water proportion of the first cooling water circuit that is conducted via the first heat exchanger and a second cooling water proportion of the first cooling water circuit that is conducted via the heat exchanger bypass, and a second cooling water circuit, wherein the second cooling water circuit and the first cooling water circuit are coupled via a second heat exchanger, in a region of which the cooling water of the second cooling water circuit is cooled by the cooling water of the first cooling water circuit, the second cooling water circuit includes a second heat exchanger bypass to the second heat exchanger coupling the second cooling water circuit and the sea water part system or the second cooling water circuit and the first cooling water circuit and a second control valve that determines a proportion of the second cooling water circuit that is conducted via the second heat exchanger and a cooling water proportion of the second cooling water circuit that is conducted via the heat exchanger bypass, the method comprising:

controlling a position of the control valve such that an advance cooling water temperature due to a mixture of the first cooling water proportion and the second cooling water proportion correspond to a set point value; controlling a rotational speed of the sea water pump based on the position of the control valve;

controlling a position of the second control valve such that a return cooling water temperature upstream of the second heat exchanger corresponds to a respective set point value; and controlling the rotational speed of the sea water pump based at least in part on the position of the second control valve.

2. The method according to claim 1, wherein the rotational speed of the sea water pump is controlled such that the first cooling water proportion increases towards a corresponding set point value.

3. The method according to claim 2, wherein the rotational speed of the sea water pump is reduced.

4. The method according to claim 2, wherein the rotational speed of the sea water pump is controlled based on a temperature of the sea water downstream of the first heat exchanger.

5. The method according to claim 1, wherein the rotational speed of the sea water pump is controlled based on a temperature of the sea water downstream of the first heat exchanger.

6. The method according to claim 5, further comprising:

Increasing the rotational speed of the sea water pump when the temperature of the sea water downstream of the first heat exchanger is greater than a limit value so that the temperature of the sea water becomes smaller than the limit value or equal to the limit value.

7. The method according to claim 1, further comprising:

reducing the rotational speed of the sea water pump such that the first cooling water proportion of the first cooling water circuit that is conducted via the first heat exchanger increases towards a corresponding set point value, and the cooling water proportion of the second cooling water circuit that is conducted via the second heat exchanger of the second cooling water circuit becomes as large as possible and is approximated in the direction of a respective set point value.

8. The method according to claim 1, wherein the first cooling water circuit further includes a cooling water pump, a low-temperature charge air cooler, at least one cooler for cooling at least one further assembly, and a further control valve configured to adjust a cooling water proportion of the first cooling water circuit conducted via the low-temperature charge air cooler, the method further comprising:

controlling a rotational speed of the cooling water pump of the first cooling water circuit based at least in part the position of at least one of the control valves.

9. The method according to claim 8, wherein the rotational speed of the cooling water pump of the first cooling water circuit is controlled dependent on the position of the control valves of the first cooling water circuit such that the cooling water proportion of the first cooling water circuit conducted via the low-temperature charge air cooler increases towards a corresponding set point value.

10. The method according to claim 9, wherein the rotational speed of the cooling water pump of the first cooling water circuit is controlled based at least in part on a temperature of the at least one cooler for cooling at least one further assembly.

11. The method according to claim 1, wherein the second cooling water circuit and the first cooling water circuit are coupled via the second heat exchanger, the rotational speed of a cooling water pump of the first cooling water circuit is controlled based at least in part on the position of the control valve of the second cooling water circuit.

12. The method according to claim 1, wherein the second cooling water circuit includes a high-temperature charge air cooler and a cooling water pump, wherein the rotational speed of the cooling water pump of the second cooling water circuit is controlled based at least in part on an internal combustion engine.

13. The method according to claim 1, wherein the first cooling water circuit comprises a cooling water pump, a low-temperature charge air cooler, a high-temperature charge air cooler, at least one cooler for cooling at least one further assembly, and a first further control valve as well as a second further control valve, via a respective switching position of the first further control valve and the second further control valve a cooling water proportion conducted via the low-temperature charge air cooler and a cooling water proportion conducted via the high-temperature charge air cooler is adjustable, the method further comprising:

controlling a rotational speed of the cooling water pump of the first cooling water circuit based at least in part on the position of at least one control valve.

14. The method according to claim 13, wherein the rotational speed of the cooling water pump of the first cooling water circuit is reduced such that the cooling water proportion conducted via the high-temperature charge air cooler increases towards a corresponding set point value.

* * * * *